US011369822B2

(12) United States Patent
Chen

(10) Patent No.: US 11,369,822 B2
(45) Date of Patent: Jun. 28, 2022

(54) RESISTANCE DEVICE

(71) Applicant: Beijing Xburn technology CO. Ltd, Beijing (CN)

(72) Inventor: Gang Chen, Xiamen (CN)

(73) Assignee: BEIJING XBURN TECHNOLOGY CO. LTD, Beijing (CN)

( * ) Notice: Subject to any disclaimer, the term of this patent is extended or adjusted under 35 U.S.C. 154(b) by 0 days.

(21) Appl. No.: 17/257,017

(22) PCT Filed: Jul. 1, 2020

(86) PCT No.: PCT/CN2020/099672
§ 371 (c)(1),
(2) Date: Dec. 30, 2020

(87) PCT Pub. No.: WO2021/128789
PCT Pub. Date: Jul. 1, 2021

(65) Prior Publication Data

US 2021/0370123 A1 Dec. 2, 2021

(30) Foreign Application Priority Data

Dec. 23, 2019 (CN) ..... 201911333906.4

(51) Int. Cl.
*A63B 21/005* (2006.01)
*A63B 21/00* (2006.01)

(52) U.S. Cl.
CPC ..... *A63B 21/0058* (2013.01); *A63B 21/153* (2013.01); *A63B 21/154* (2013.01); *A63B 21/156* (2013.01)

(58) Field of Classification Search
CPC ..... A63B 21/005; A63B 21/0051; A63B 21/0052; A63B 21/0056; A63B 21/0058;
(Continued)

(56) References Cited

U.S. PATENT DOCUMENTS 3,640,530 A * 2/1972 Henson ..... A63B 21/153 73/379.06
4,045,001 A * 8/1977 Harvey, Jr. ..... B66D 1/36 242/157.1
(Continued)

FOREIGN PATENT DOCUMENTS

CN 1597025 A 3/2005
CN 107096164 A 8/2017
(Continued)

*Primary Examiner* — Nyca T Nguyen
*Assistant Examiner* — Zachary T Moore
(74) *Attorney, Agent, or Firm* — Bayramoglu Law Offices LLC

(57) ABSTRACT

A resistance device includes a resistance source, a winch, a draw rope, a pulley block, a wire management mechanism, a draw wire and a fixed plate. The output end of the resistance source is connected to one end of the winch, and the other end of the winch is pivotably connected to the fixed plate. The wire management mechanism is arranged between the fixed plate and the resistance source. One end of the draw rope is fixedly arranged on the winch, and the other end of the draw rope protrudes out of the wire management mechanism. A bobbin is convexly arranged at an end portion of the other end of the winch. The pulley block includes at least one fixed pulley and at least one movable pulley. The fixed pulley is fixedly arranged on the fixed plate, and the movable pulley is fixedly arranged on the wire management mechanism.

10 Claims, 6 Drawing Sheets

(58) Field of Classification Search
CPC ... A63B 21/0059; A63B 21/15; A63B 21/151; A63B 21/153; A63B 21/154; A63B 21/155; A63B 21/156; A63B 21/157; A63B 2022/0079; A63B 22/0076; A63B 22/0089; B66D 1/30; B66D 1/34; B66D 1/36; B66D 1/38; B66D 1/39
See application file for complete search history.

(56) References Cited

U.S. PATENT DOCUMENTS

| | | | | |
|---|---|---|---|---|
| 5,304,104 | A * | 4/1994 | Chi | A63B 21/0058 482/99 |
| 6,790,163 | B1 * | 9/2004 | Van De Laarschot | A63B 21/0056 434/254 |
| 8,789,812 | B2 * | 7/2014 | Imbusch | B66D 1/28 254/380 |
| 2012/0118208 | A1 * | 5/2012 | Kim | B66D 1/39 254/331 |
| 2018/0346295 | A1 * | 12/2018 | Kosuga | B66D 3/26 |

FOREIGN PATENT DOCUMENTS

| | | | |
|---|---|---|---|
| CN | 107096165 | A | 8/2017 |
| CN | 107614067 | A | 1/2018 |
| CN | 110947154 | A | 4/2020 |

* cited by examiner

RESISTANCE DEVICE

CROSS REFERENCE TO THE RELATED APPLICATIONS

This application is the national phase entry of International Application No. PCT/CN2020/099672, filed on Jul. 1, 2020, which is based upon and claims priority to Chinese Patent Application No. 201911333906.4, filed on Dec. 23, 2019, the entire contents of which are incorporated herein by reference.

TECHNICAL FIELD

The present invention relates to the technical field of motor resistance, in particular to a resistance device.

BACKGROUND

A motor resistance device is used in auxiliary sports equipment which allows the user to adjust the resistance of the equipment. It is most often used in fitness facilities. In the prior art, it is known that the motor resistance device is mainly composed of a servo motor, a roller, a coupling device, and a draw rope wound on the roller. The roller is pivotably arranged on a bottom plate through a bearing base. The servo motor is controlled by an existing servo controller and a computer. The servo motor is connected to the roller through the coupling, and the transmission connection between the servo motor and the roller can also be realized by the two transmission wheels of another transmission connection structure and the belt therebetween. The draw rope can be pulled to enable the roller to rotate around a rotating shaft. When the motor (generally a servo motor) is in a braking state, the resistance generated by the motor acts on the draw rope. When the pulling force acting on the draw rope decreases, the resistance provided by the motor decreases, otherwise the resistance increases. The resistance disappears when the draw rope is loosened. In this way, the draw rope is pulled back and forth to realize the process of physical exercise.

However, the prior motor resistance device usually uses a thread structure to guide the draw rope to prevent the draw rope from being cross-wound, which increases the manufacturing costs and precision requirements of the motor resistance device, otherwise, it is possible to press the draw rope, and the friction between the draw rope and the thread increases the resistance.

In view of the above, the inventor of the present invention has conducted in-depth research on the resistance device and proposes the present invention.

SUMMARY

Objectives of the present invention are to provide a resistance device that has a simple structure, ability to reduce the resistance of the draw rope, reduce the manufacturing cost, reduce the manufacturing precision requirements and ensure the orderly winding of the draw rope.

In order to achieve the above purpose, the present invention adopts the following technical solutions. A resistance device includes a resistance source, a winch, a draw rope, a pulley block, a wire management mechanism, a draw wire and a fixed plate. The output end of the resistance source is connected to one end of the winch, and the other end of the winch is pivotably connected to the fixed plate. The wire management mechanism is arranged between the fixed plate and the resistance source. One end of the draw rope is fixedly arranged on the winch, and the other end of the draw rope protrudes out of the wire management mechanism. A bobbin is convexly arranged at an end portion of the other end of the winch. The pulley block includes at least one fixed pulley and at least one movable pulley. The fixed pulley is fixedly arranged on the fixed plate, and the movable pulley is fixedly arranged on the wire management mechanism. One end of the draw wire is fixedly arranged on the bobbin, and the draw wire is wound between the bobbin, the fixed pulley and the movable pulley. When the resistance source drives the winch to rotate, the bobbin rotates to enable the draw wire to be wound or loosened, and the draw wire drives the wire management mechanism, and the wire management mechanism drives the draw rope to be orderly wound on the winch.

The resistance source is a motor.

The wire management mechanism is a moving mechanism of the cooperation of a guide rail and a sliding block, or a rod swing mechanism.

The guide rail is fixedly arranged between the fixed plate and the resistance source, and the sliding block is slidably sleeved on the guide rail.

A base is fixedly arranged above the sliding block. The base is provided with a through hole, and the other end of the draw rope protrudes out of the through hole. A secondary fixed pulley with a groove is arranged at one side of the through hole, and the draw rope is clamped into the groove of the secondary fixed pulley. The movable pulley is arranged at the other side of the through hole.

The resistance device further includes two bottom supporting members, and the two bottom supporting members are arranged under both sides of the winch at an interval. The bottom supporting members are fixedly connected between the fixed plate and the resistance source. The rod swing mechanism includes a pulley shaft and at least one connecting rod. The pulley shaft penetrates the movable pulley. An end of the pulley shaft is fixed to the connecting rod, and the bottom end of the connecting rod is rotatably connected to a connecting block sleeved on the bottom supporting member.

The rod swing mechanism includes a pulley shaft, a triangle block and at least one connecting rod. The pulley shaft penetrates the movable pulley. An end of the pulley shaft is fixed to one corner of the triangle block. The guide rail is fixed between the fixed plate and the resistance source. The top end of the connecting rod is rotatably connected to the guide rail, and the bottom end of the connecting rod is connected to the other corner of the triangle block. The last corner of the triangle block is connected to a connecting bar, and the connecting bar is rotatably connected to the fixed plate.

The resistance device further includes a coil spring assembly. The coil spring assembly includes a coil spring housing and a coil spring, and the coil spring housing is affixed to the fixed plate. One end of the coil spring is fixedly arranged on the coil spring housing, and the other end of the coil spring is fixedly arranged on the other end of the winch.

The resistance device further includes a housing fixed between the resistance source and the fixed plate. The housing covers the winch, and the other end of the draw rope protrudes out of the housing. The housing is provided with a rope groove, and the draw rope moves in the rope groove.

The resistance device further includes a spring. One end of the spring is linked with the wire management mechanism, and the other end of the spring is fixed to the resistance source.

After adopting the above solution, in the present invention, the thread structure is replaced with the pulley block, and the cooperation of the pulley block, the wire management mechanism and the draw wire plays the role of guiding the rope and reduces the resistance in the process of guiding the rope, that is, when the draw rope is in the process of being wound on the winch, the bobbin is driven to enable the draw wire to be loosened from the bobbin. The wire management mechanism moves to gradually extend the length of the draw wire between the movable pulley and the fixed pulley, and the draw rope is linked with the wire management mechanism, so that the wire management mechanism drives the draw rope to be orderly wound on the winch. Therefore, the present invention can reduce the manufacturing cost, reduce the manufacturing precision requirements and ensure the orderly winding of the draw rope, and the overall structure is simple.

Figure 1:
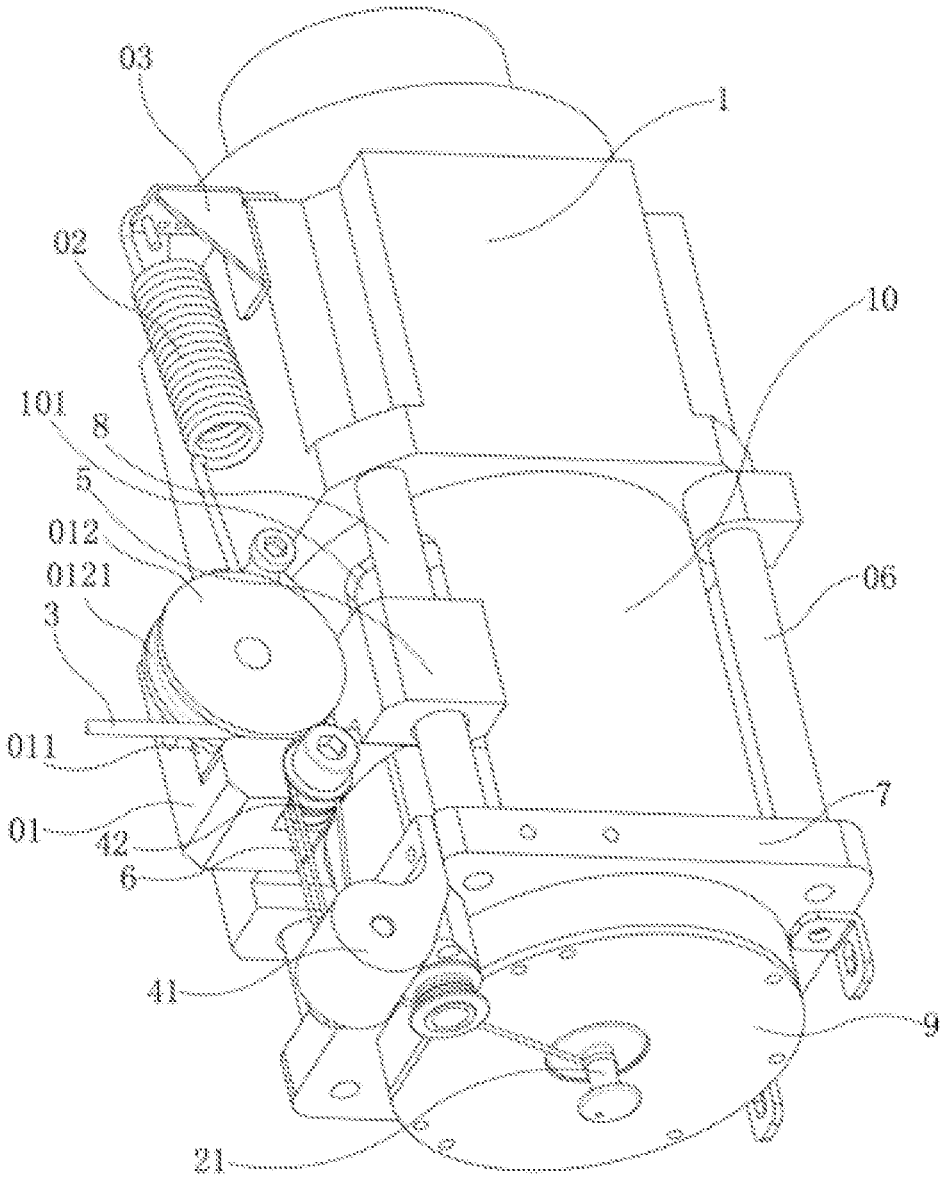
FIG. 1 is a first perspective view of Embodiment 1 of the present invention.

DESCRIPTION OF REFERENCE NUMBERS motor 1
winch 2
bobbin 21
draw rope 3
pulley block 4
fixed pulley 41
movable pulley 42
sliding block 5
draw wire 6
fixed plate 7
guide rail 8
coil spring assembly 9
housing 10
rope groove 101
base 01
through hole 011
secondary fixed pulley 012
groove 0121
spring 02
supporting frame 03
gasket 04
bearing 05
bottom supporting members 06
pulley shaft 071
connecting rod 072
connecting block 073
spring pull plate 074
triangle block 075
connecting bar 076
external structure 1' of the leg stretching machine
resistance module housing 2'
linking pulley 4'
first linking pulley 41'
second linking pulley 42'
cam plate 5'
handle 7', 9'
position adjustment mechanism 6', 8'

DETAILED DESCRIPTION OF THE EMBODIMENTS

In order to achieve the above-mentioned purposes and effects, the preferred embodiments of the present invention are illustrated below in details with reference to the drawings of for a complete understanding of the technical means and structure adopted by the present invention.

Referring to FIGS. 1 to 5, the present invention provides a resistance device, including a resistance source, the winch 2, the draw rope 3, the pulley block 4, the wire management mechanism, the draw wire 6 and the fixed plate 7. The output end of the resistance source is connected to one end of the winch 2, and the other end of the winch 2 is pivotably connected to the fixed plate 7. The wire management mechanism is arranged between the fixed plate 7 and the resistance source. One end of the draw rope 3 is fixedly arranged on the winch 2, and the other end of the draw rope 3 protrudes out of the wire management mechanism. The bobbin 21 is convexly arranged at the end portion of the other end of the winch 2. The pulley block 4 includes at least one fixed pulley 41 and at least one movable pulley 42. The fixed pulley 41 is fixedly arranged on the fixed plate 7, and the movable pulley 42 is fixedly arranged on the wire management mechanism. One end of the draw wire 6 is fixedly arranged on the bobbin 21, and the draw wire 6 is wound between the bobbin 21, the fixed pulley 41 and the movable pulley 42. The draw rope 3 is liked with the wire management mechanism. When the resistance source drives the winch 2 to rotate, the bobbin 21 rotates to enable the draw wire 6 to be wound or loosened, the draw wire 6 drives the wire management mechanism, and the wire management mechanism drives the draw rope 3 to be orderly wound on the winch 2. In an embodiment, the other end of the draw wire 6 may be fixed on the fixed plate 7, but is not limited thereto. The other end of the draw wire 6 may also be fixed on the wire management mechanism, or be rewound to the bobbin 21, or other places for fixing.

Therefore, in the present invention, the thread structure is replaced with the pulley block 4, and the cooperation of the pulley block 4, the wire management mechanism and the draw wire 6 plays the role of guiding the rope and reduces the resistance in the process of guiding the rope, that is, when the draw rope 3 is in the process of being wound on the winch 2, the bobbin 21 is driven to enable the draw wire 6 to be loosened from the bobbin 21. The wire management mechanism moves to gradually extend the length of the draw wire 6 between the movable pulley 42 and the fixed pulley 41, and the draw rope 3 is linked with the wire management mechanism, so that the wire management mechanism drives the draw rope 3 to be orderly wound on the winch 2. Therefore, the present invention can reduce the manufacturing cost, reduce the manufacturing precision requirements and ensure the orderly winding of the draw rope 3, and the overall structure is simple.

The resistance source may be any one of the motor 1, the electromagnetic brake device, the magnetic powder brake device, the wind resistance generating device, or the water resistance generating device. The embodiment of the present invention takes the motor 1 as the resistance source for illustration. The electromagnetic brake device, the magnetic powder brake device, the wind resistance generating device and the water resistance generating device are well-known in the art, and will not be repeated here. The wire management mechanism is a moving mechanism of the cooperation of the guide rail 8 and the sliding block 5, or a rod swing mechanism.

The present invention may further include the coil spring assembly 9. The coil spring assembly 9 includes a coil spring housing (not shown in the figures) and a coil spring (not shown in the figures). The coil spring housing is affixed to the fixed plate 7. One end of the coil spring is fixedly arranged on the coil spring housing, and the other end of the coil spring is fixedly arranged on the other end of the winch 2, so that when a force is applied to enable the draw rope 3 to be loosened from the winch 2, the coil spring wound on the other end of the winch 2 will be tightened, and when no force is applied, under the action of the elastic resetting force of the coil spring, the coil spring will unwind, so that the draw rope 3 is automatically wound again on the winch 2 to automatically reset.

The present invention further includes the housing 10 and two bottom supporting members 06. The housing 10 is fixedly arranged between the motor 1 and the fixed plate 7, and the two bottom supporting members 06 are arranged under both sides of the winch 2 at an interval. The housing 10 covers the winch 2, and the other end of the draw rope 3 protrudes out of the housing 10. The housing 10 is provided with the rope groove 101, and the draw rope 3 moves in the rope groove 101. The bottom supporting members 06 are fixedly connected between the fixed plate 7 and the motor 1.

The output end of the motor 1 may be connected to one end of the winch 2 by the gasket 04 and the bearing 05 that are sleeved on the output end of the motor 1, that is, the output end of the motor 1, the gasket 04 and the bearing 05 are arranged in one end of the winch 2, so that the rotation of the output end of the motor 1 hinders the rotation of the winch 2.

In addition, the present invention may further include the spring 02. One end of the spring 02 is linked with the wire management mechanism, and the other end of the spring is fixed to the motor 1, thereby facilitating the reciprocating motion of the wire management mechanism by using the spring 02.

Figure 2:
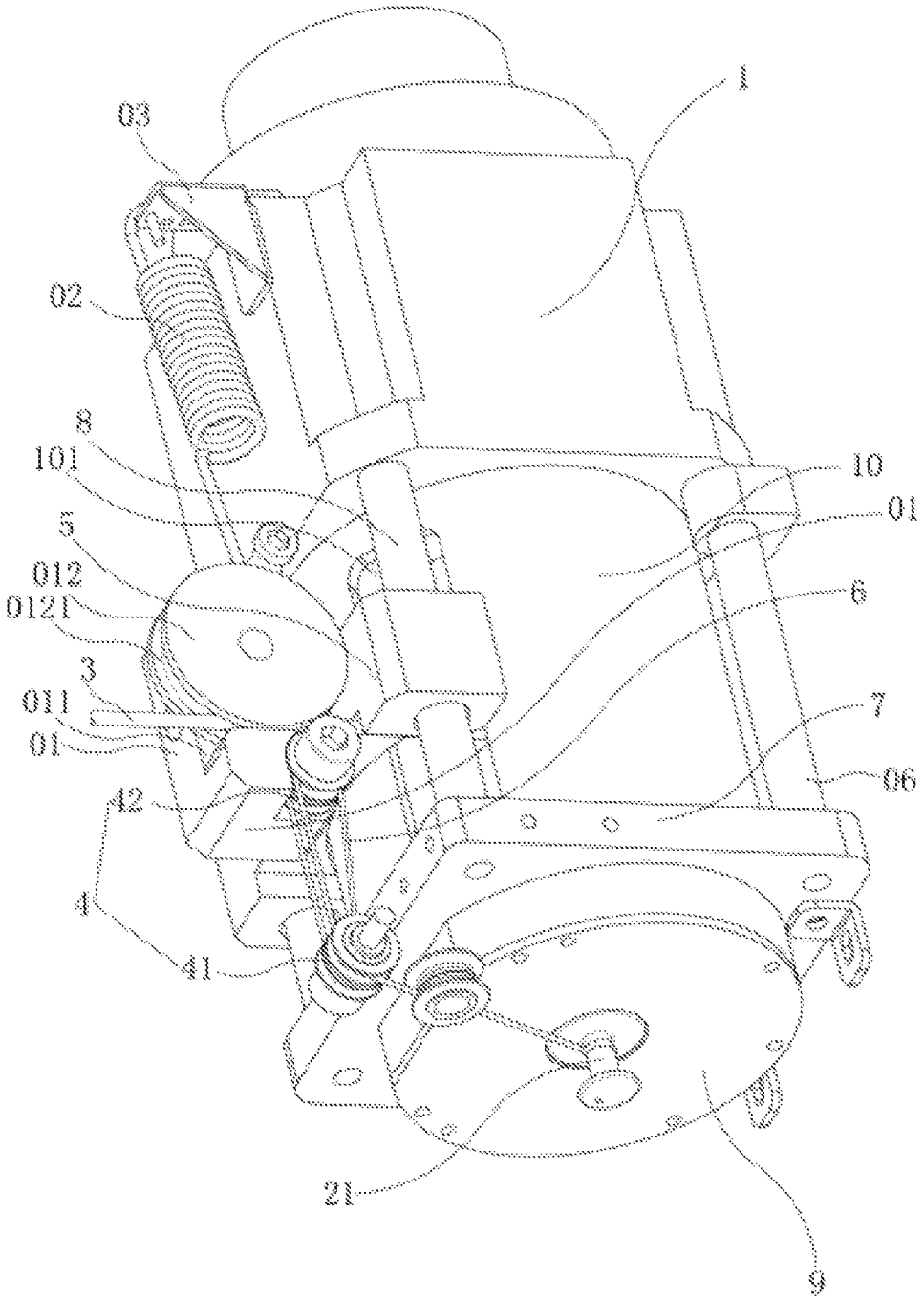
FIG. 2 is a second perspective view of Embodiment 1 of the present invention.
Figure 3:
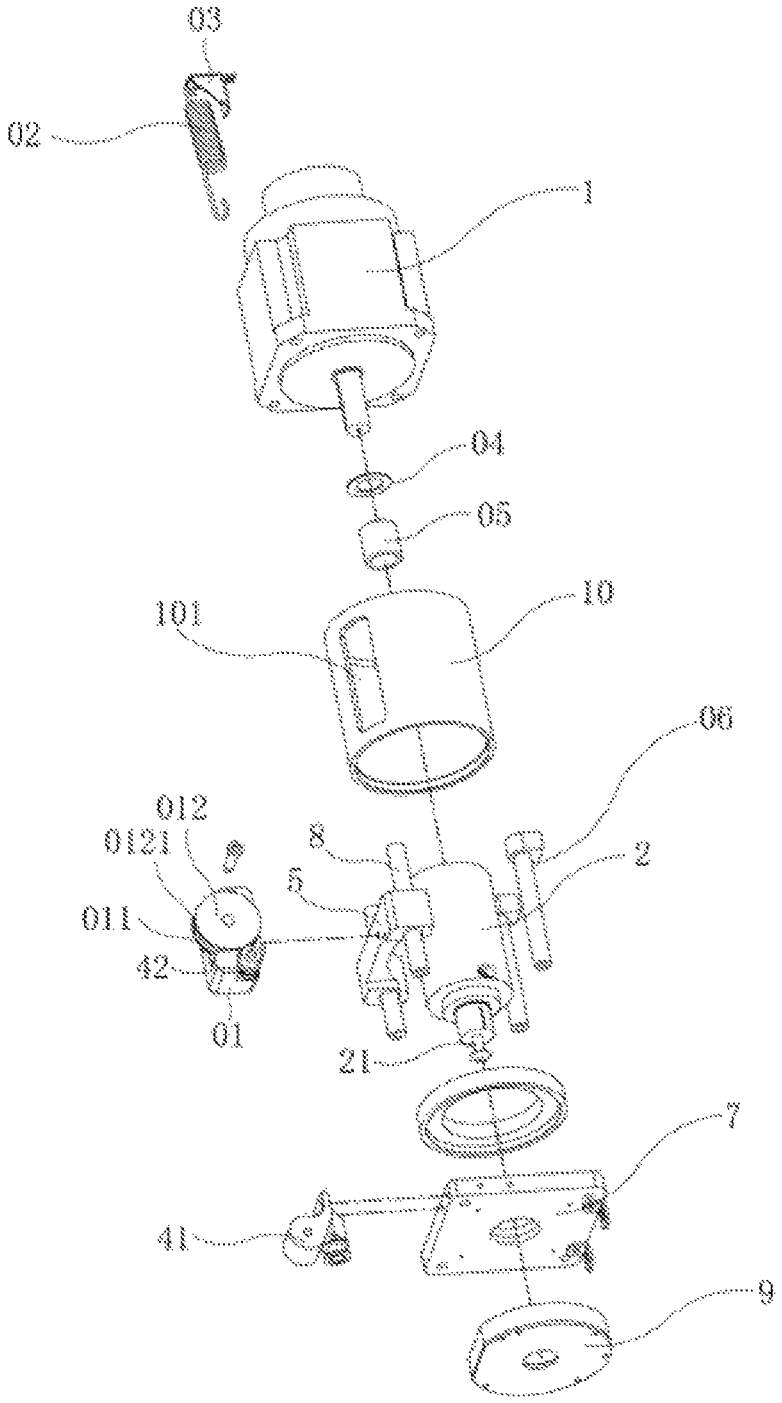
FIG. 3 is an exploded view of FIG. 1.

The differences between Embodiment 1, Embodiment 2 and Embodiment 3 of the present invention are as follows:

Referring to FIGS. 1 to 3, in Embodiment 1 of the present invention, the wire management mechanism employs a moving mechanism of the cooperation of the guide rail 8 and the sliding block 5. The guide rail 8 is fixedly arranged between the fixed plate 7 and the motor 1, and the sliding block 5 is slidably sleeved on the guide rail 8. The other end of the draw rope 3 protrudes out of the sliding block 5, and the movable pulley 42 is fixed on the sliding block 5. The other end of the draw rope 3 is linked with the sliding block 5 to enable the movement distance of the sliding block 5 to be equal to the movement distance of the draw rope 3 on the winch 2. The fixed pulley 41 is covered with the housing in FIG. 1, the fixed pulley 41 is not covered with the housing in FIG. 2, and in this embodiment, the sliding block 5 is U-shaped, so that the draw rope 3 can abut the wall surface of the sliding block 5 and move. The shape of the sliding block 5 is not limited thereto, and a rectangular block with a through hole for the draw rope 3 to slide can also be employed to enable the other end of the draw rope 3 to be linked with the sliding block 5.

Further, one end of the spring 02 is linked with the sliding block 5, the other end of the spring 02 is fixed to the motor 1, so that when the draw rope 3 is in the process of being wound on the winch 2, the bobbin 21 is driven to enable the draw wire 6 to be loosened from the bobbin 21. The sliding block 5 moves toward the other end of the spring 02 under the elastic force of the spring 02, so that the length of the draw wire 6 between the movable pulley 42 and the fixed pulley 41 is gradually extended. The other end of the draw rope 3 is linked with the sliding block 5, so that the sliding block 5 drives the draw rope 3 to be orderly wound on the winch 2.

Further, the base 01 is fixedly arranged above the sliding block 5. The base 01 is provided with the through hole 011, and the other end of the draw rope 3 protrudes out of the through hole 011. The secondary fixed pulley 012 with the groove 0121 is arranged at one side of the through hole 011, and the draw rope 3 is clamped into the groove 0121 of the secondary fixed pulley 012. The movable pulley 042 is arranged on at the other side of the through hole 011 to facilitate the application of force to the draw rope 3, reduce the resistance of the draw rope 3, and enable the other end of the draw rope 3 to be linked with the sliding block 5.

One end of the spring 02 is fixedly arranged on the base 01, the supporting frame 03 is fixedly arranged on the motor 1, and the other end of the spring 02 is fixedly arranged on the supporting frame 03, so that when a force is applied to enable the draw rope 3 to be loosened from the winch 2, the sliding block 5 drives the base 01 to move toward the fixed plate 7 and stretches the spring 02, and when no force is applied, the sliding block 5 moves toward the other end of the spring 02 under the action of the elastic force of the spring 02, so that the length of the draw wire 6 between the movable pulley 42 and the fixed pulley 41 is gradually extended, The other end of the draw rope 3 is linked with the sliding block 5, so that the sliding block 5 drives the draw rope 3 to be automatically wound again on the winch 2 to automatically reset.

Figure 4:
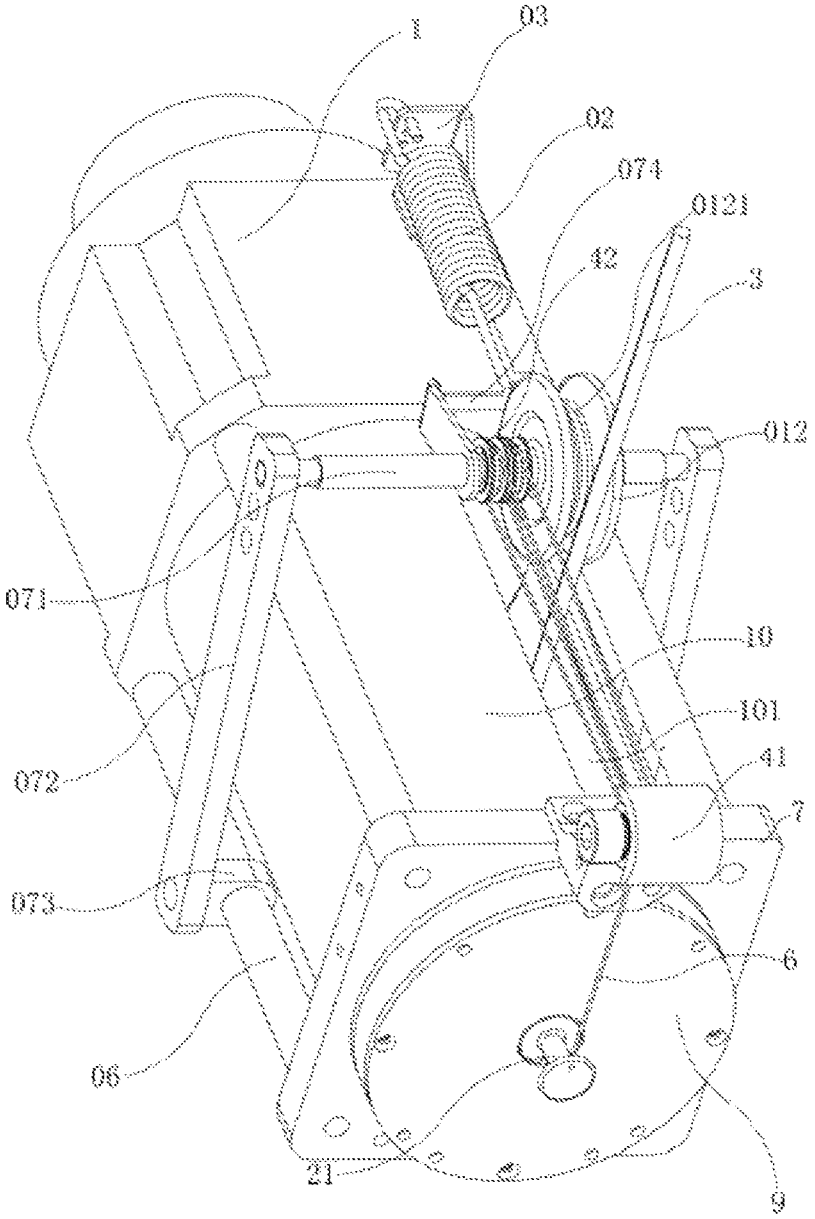
FIG. 4 is a perspective view of Embodiment 2 of the present invention.

Referring to FIG. 4, in Embodiment 2 of the present invention, the wire management mechanism employs a rod swing mechanism. The rod swing mechanism includes the pulley shaft 071 and at least one connecting rod 072. The pulley shaft 071 penetrates the movable pulley 42. An end of the pulley shaft 071 is fixed to the connecting rod 072, and the bottom end of the connecting rod 072 is rotatably connected to the connecting block 073 sleeved on the bottom supporting member 06, so that the connecting rod 071 swings to drive the pulley shaft 071 and the movable pulley 42, so as to enable the draw rope 3 to be orderly wound on the winch 2, and the swinging distance of the connecting rod 072 is equal to the movement distance of the draw rope 3 on the winch 2.

The present invention may further include the spring pull plate 074, and the secondary fixed pulley 012 with the groove 0121. The draw rope 3 is clamped into the groove 0121 of the secondary fixed pulley 012. The pulley shaft 071 penetrates the secondary fixed pulley 012 and the spring pull plate 074. The spring pull plate 074 may be U-shaped. The supporting frame 03 is fixedly arranged on the motor 1. One end of the spring 02 is fixedly arranged on the spring pull plate 074, and the other end of the spring 02 is fixedly arranged on the supporting frame 03. The spring pull plate 074 clamps the secondary fixed pulley 012 and the movable pulley 42. Therefore, the spring 02 is capable of driving the pulley shaft 071 to reciprocate to gradually change the length of the draw wire 6 between the movable pulley 42 and the fixed pulley 41.

Figure 5:
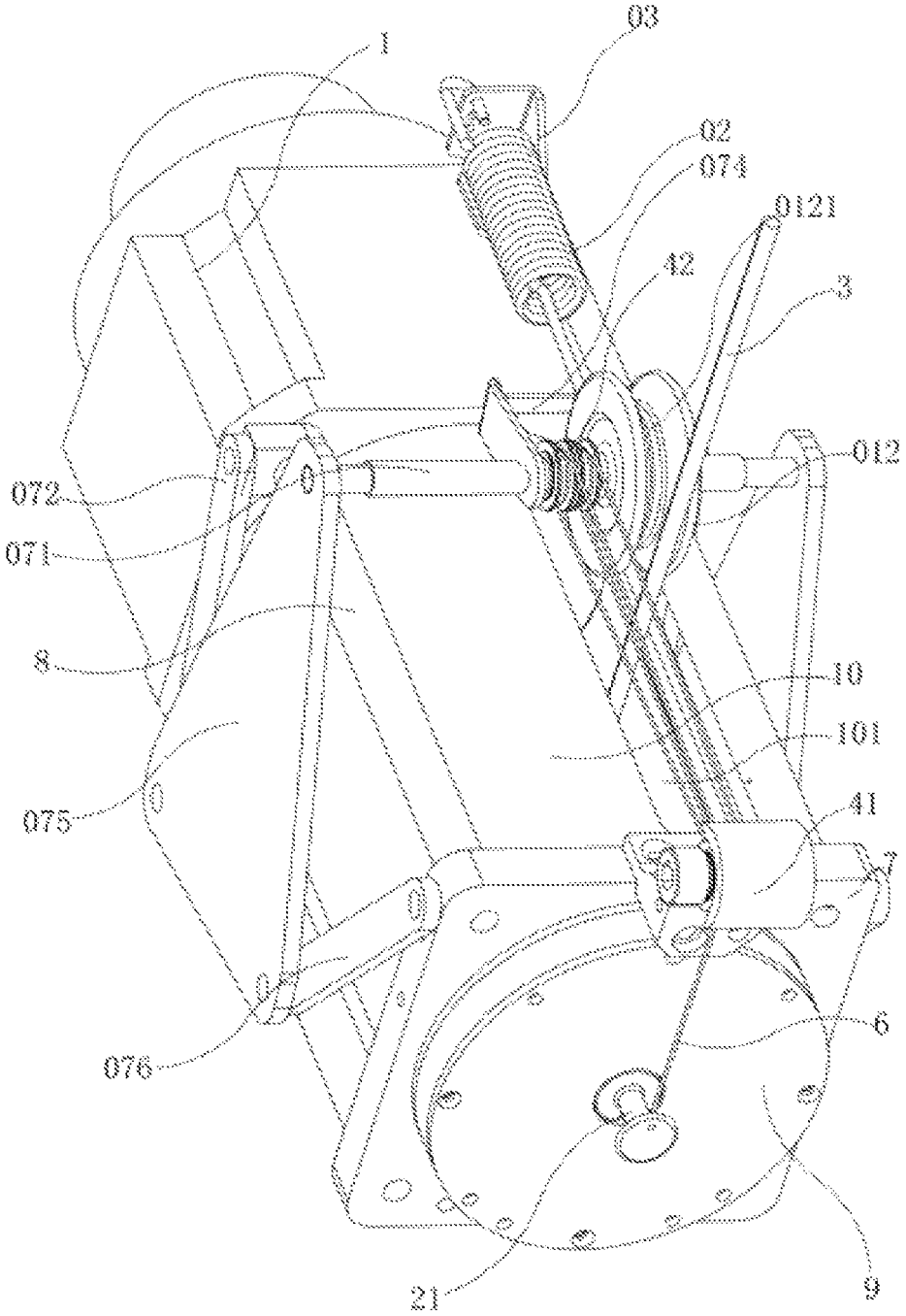
FIG. 5 is a perspective view of Embodiment 3 of the present invention.

Referring to FIG. 5, in Embodiment 3 of the present invention, the wire management mechanism employs a rod swing mechanism. The rod swing mechanism includes the pulley shaft 071, the triangle block 075 and at least one connecting rod 072. In this embodiment, the number of the connecting rods 072 and the number of the triangle blocks 075 are both two, but are not limited thereto. The pulley shaft 071 penetrates the movable pulley 42. An end of the pulley shaft 071 is fixed to one corner of the triangle block 075. The guide rail 8 is fixed between the fixed plate 7 and the motor 1. The top end of the connecting rod 072 is rotatably connected to the guide rail 8, and the bottom end of the connecting rod 072 is connected to the other corner of the triangle block 075. The last corner of the triangle block 075 is connected to the connecting bar 076, and the connecting bar 076 is rotatably connected to the fixed plate 7. Therefore, the connecting rod 072 and the triangle block 075 cooperate to swing to drive the pulley shaft 071 and the movable pulley 42, so as to enable the draw rope 3 to be orderly wound on the winch 2, and the swinging distance of one corner of the triangle block 075 is equal to the movement distance of the draw rope 3 on the winch 2.

The present invention may further include the spring pull plate 074, and the secondary fixed pulley 012 with the groove 0121. The draw rope 3 is clamped into the groove 0121 of the secondary fixed pulley 012. The pulley shaft 071 penetrates the secondary fixed pulley 012 and the spring pull plate 074. The spring pull plate 074 may be U-shaped. The supporting frame 03 is fixedly arranged on the motor 1. One end of the spring 02 is fixedly arranged on the spring pull plate 074, and the other end of the spring 02 is fixedly arranged on the supporting frame 03. The spring pull plate 074 clamps the secondary fixed pulley 012 and the movable pulley 42. Therefore, the spring 02 is capable of driving the pulley shaft 071 to reciprocate to gradually change the length of the draw wire 6 between the movable pulley 42 and the fixed pulley 41.

Figure 6:
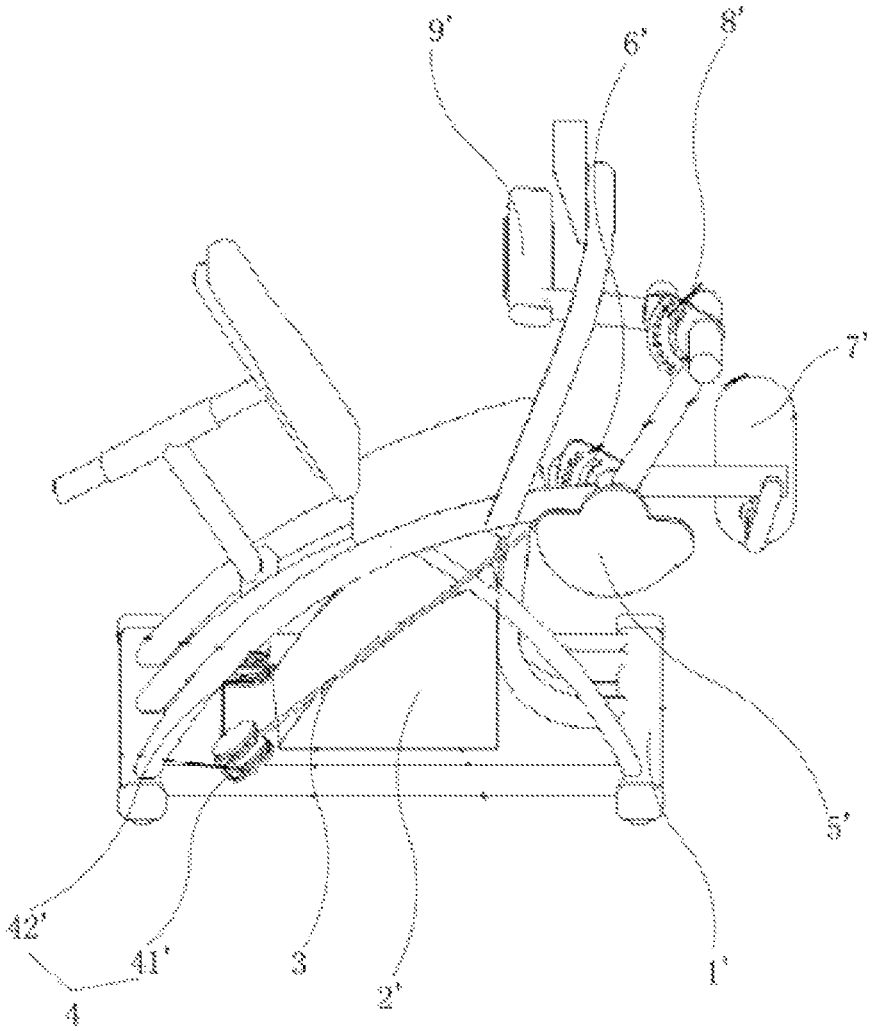
FIG. 6 is a schematic diagram of the structure of the present invention when applied to a fitness equipment.

Referring to FIG. 6, which shows a leg stretching machine of strength training equipment using the present invention. The strength training equipment mainly includes the external structure 1' of the leg stretching machine, and the resistance module housing 2'. The present invention is installed in the resistance module housing 2', and the resistance module housing 2' is provided with an opening through which the draw rope 3 extends from the present invention to the outside. The linking pulley 4' is fixed on the external structure 1' of the leg stretching machine. The linking pulley 4' includes the first linking pulley 41' and the second linking pulley 42'. The draw rope 3 extends out of the resistance module housing 2', first passes through the second linking pulley 42', then passes through the first linking pulley 41', and finally winds to the cam plate 5' fixed on the external structure 1' of the leg stretching machine. When the calf does the stretching training, the handle 7' covered with sponge balls of the external structure 1' of the leg stretching machine is driven to move to drive the cam plate 5' to rotate, and the cam plate 5' rotates to stretch the draw rope 3. The handle 7' is rigidly connected to the position adjustment mechanism 6' provided on the external structure 1' of the leg stretching machine. The position adjustment mechanism 6' changes the position of the handle 7' by changing the angle of the rigidly connected mechanism through a pin, and the calf does the stretching training by pushing the handle 7'. The other handle 9' of the external structure 1' of the leg stretching machine for fixing the thigh is rigidly connected to the other position adjustment mechanism 8' provided on the external structure 1' of the leg stretching machine. The other position adjustment mechanism 8' changes the angle of the rigidly connected mechanism by changing the position of the pin, so as to change the position of the other handle 9' for fixing the thigh.

The technical content and technical features of the present invention have been disclosed as above. The number of components of the present invention is not limited to the above. Those skilled in the art may still make various replacements and modifications based on the disclosure of the present invention without departing from the spirit of the present invention. Therefore, the scope of protection of the present invention is not be limited to the embodiments disclosed, and those replacements and modifications made without departing from the present invention shall fall within the scope of protection of the present invention and be encompassed by the claims.

What is claimed is:

1. A resistance device, comprising a resistance source, a winch, a draw rope, a pulley block, a wire management mechanism, a draw wire and a fixed plate; wherein an output end of the resistance source is connected to a first end of the winch, and a second end of the winch is pivotably connected to the fixed plate;

the wire management mechanism is arranged between the fixed plate and the resistance source;

a first end of the draw rope is fixedly arranged on the winch, and a second end of the draw rope protrudes out of the wire management mechanism;

a bobbin is convexly arranged at an end portion of the second end of the winch;

the pulley block comprises at least one fixed pulley and at least one movable pulley;

the at least one fixed pulley is fixedly arranged on the fixed plate, and the at least one movable pulley is fixedly arranged on the wire management mechanism;

one end of the draw wire is fixedly arranged on the bobbin, and the draw wire is wound between the bobbin, the at least one fixed pulley and the at least one movable pulley;

when the resistance source drives the winch to rotate, the bobbin rotates to enable the draw wire to be wound or loosened, and the draw wire drives the wire management mechanism, and the wire management mechanism drives the draw rope to be orderly wound on the winch.

2. The resistance device according to claim 1, wherein, the resistance source is a motor.

3. The resistance device according to claim 1, wherein, the wire management mechanism is a moving mechanism configured for cooperation of a guide rail and a sliding block, or the wire management mechanism is a rod swing mechanism.

4. The resistance device according to claim 3, wherein, the guide rail is fixedly arranged between the fixed plate and the resistance source, and the sliding block is slidably sleeved on the guide rail.

5. The resistance device according to claim 3, wherein, a base is fixedly arranged above the sliding block; the base is provided with a through hole, and the second end of the draw rope protrudes out of the through hole; a secondary fixed pulley with a groove is arranged at a first side of the through hole, and the draw rope is clamped into the groove of the secondary fixed pulley; the at least one movable pulley is arranged at a second side of the through hole.

6. The resistance device according to claim 3, further comprising two bottom supporting members, wherein the two bottom supporting members are arranged under both sides of the winch at an interval; the two bottom supporting members are fixedly connected between the fixed plate and the resistance source; the rod swing mechanism comprises a pulley shaft and at least one connecting rod; the pulley shaft penetrates the at least one movable pulley; an end of the pulley shaft is fixed to each connecting rod of the at least one connecting rod, and a bottom end of the each connecting rod is rotatably connected to a connecting block; and the connecting block is sleeved on each of the two bottom supporting members.

7. The resistance device according to claim 3, wherein, the rod swing mechanism comprises a pulley shaft, a triangle block and at least one connecting rod; the pulley shaft penetrates the at least one movable pulley; an end of the pulley shaft is fixed to a first corner of the triangle block; the guide rail is fixed between the fixed plate and the resistance source; a top end of each connecting rod of the at least one connecting rod is rotatably connected to the guide rail, and a bottom end of the each connecting rod is connected to a second corner of the triangle block; a third corner of the triangle block is connected to a connecting bar, and the connecting bar is rotatably connected to the fixed plate.

8. The resistance device according to claim 1, further comprising a coil spring assembly, wherein the coil spring assembly comprises a coil spring housing and a coil spring, and the coil spring housing is affixed to the fixed plate; a first end of the coil spring is fixedly arranged on the coil spring housing, and a second end of the coil spring is fixedly arranged on the second end of the winch.

9. The resistance device according to claim 1, further comprising a housing fixed between the resistance source and the fixed plate; wherein the housing covers the winch, and the second end of the draw rope protrudes out of the housing; the housing is provided with a rope groove, and the draw rope moves in the rope groove.

10. The resistance device according to claim 1, further comprising a spring, wherein a first end of the spring is linked with the wire management mechanism, and a second end of the spring is fixed to the resistance source.

* * * * *